US012753976B2

(12) United States Patent
Moradnia et al.

(10) Patent No.: US 12,753,976 B2
(45) Date of Patent: Oct. 6, 2026

(54) HEAT EXCHANGER

(71) Applicant: Honda Motor Co., Ltd., Tokyo (JP)

(72) Inventors: Pirooz Moradnia, Dublin, OH (US); Jason A Widmer, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 246 days.

(21) Appl. No.: 18/500,378

(22) Filed: Nov. 2, 2023

(65) Prior Publication Data

US 2025/0146760 A1 May 8, 2025

(51) Int. Cl.
*F28D 7/10* (2006.01)

(52) U.S. Cl.
CPC ..... *F28D 7/10* (2013.01)

(58) Field of Classification Search
CPC .. F28D 7/10; F28D 1/0233; F28D 2001/0273; F28D 1/047; F28D 1/0475; F28F 9/0263; F28F 9/0282; F28F 13/08
USPC ..... 165/177
See application file for complete search history.

(56) References Cited

U.S. PATENT DOCUMENTS

| | | | | |
|---|---|---|---|---|
| 3,256,932 | A * | 6/1966 | Schlichting | F22B 1/063 122/249 |
| 4,154,295 | A | 5/1979 | Kissinger | |
| 8,893,319 | B2 | 11/2014 | Gilbert | |
| 2006/0260789 | A1 | 11/2006 | Nakagawa et al. | |

FOREIGN PATENT DOCUMENTS

| | | | |
|---|---|---|---|
| CN | 106322846 | A | 1/2017 |
| CN | 106338162 | A | 1/2017 |
| CN | 106403397 | A | 2/2017 |
| CN | 206930187 | U | 1/2018 |
| CN | 112484557 | A | 3/2021 |
| CN | 115151776 | A * | 10/2022 |
| DE | 102012008183 | B4 | 7/2013 |
| EP | 1724543 | A1 | 11/2006 |
| GB | 929787 | A * | 6/1963 |
| KR | 20200099815 | A | 8/2020 |
| WO | 03008890 | A1 | 1/2003 |
| WO | 2020093647 | A1 | 5/2020 |

* cited by examiner

*Primary Examiner* — Travis Ruby
(74) *Attorney, Agent, or Firm* — Morgan Lincoln; American Honda Motor Co., Inc.

(57) ABSTRACT

A heat exchanger includes an inlet header, an outlet header; and a plurality of concentrically arranged bent tubes. The bent tubes extend from the inlet header to the outlet header and are arranged in same plane with the inlet header and the outlet header extending radially outwardly from a location proximate to a central axis of the heat exchanger. Moreover, a diameter of at least one of the plurality of bent tubes is different from a diameter of at least one of remaining bent tubes.

17 Claims, 6 Drawing Sheets

HEAT EXCHANGER

BACKGROUND

The disclosed subject matter relates generally to a heat exchanger. More particularly, the disclosed subject matter relates to a heat exchanger having bent tubes arranged concentrically to each other.

Current heat exchangers include series of metal straight tubes through which cold or hot fluid passes, and air, generated by a fan, is passed over the tubes to enable heat exchange between the fluid passing through the tubes and the air. However, the existing heat exchangers include one or more dead zones that either do not receive air generated by the fan or receive reduced air flow, leading to a reduction in the heat exchange efficiency of the heat exchangers.

SUMMARY

In accordance with one embodiment of the present disclosure, a heat exchanger is disclosed. The heat exchanger includes an inlet header, an outlet header, and a plurality of concentrically arranged bent tubes extending from the inlet header to the outlet header. The plurality of bent tubes is arranged coplanar to each other with the inlet header and the outlet header extending radially outwardly from a location proximate to the central axis of the heat exchanger. Moreover, a diameter of at least one of the plurality of bent tubes is different from a diameter of at least one of remaining bent tubes.

In accordance with another embodiment of the present disclosure, a heat transfer system is disclosed. The heat transfer system includes a fan and a heat exchanger arranged upstream or downstream of the fan relative to a direction of air flow generated by the fan. The heat exchanger includes an inlet header, an outlet header, and a plurality of concentrically arranged bent tubes extending from the inlet header to the outlet header. The bent tubes are arranged coplanar to each other and the inlet header and the outlet header extending radially outwardly from location proximate to a central axis of the heat exchanger. Moreover, a diameter of at least one of the plurality of bent tubes is different from a diameter of at least one of remaining bent tubes.

In accordance with yet a further embodiment of the present disclosure a heat exchanger is disclosed. The heat exchanger includes an inlet header, an outlet header arranged diametrically opposite to the inlet header, and a plurality of concentrically arranged bent tubes extending from the inlet header to the outlet header. The bent tubes are arranged coplanar to each other with the inlet header and the outlet header extending radially outwardly from a location proximate to a central axis of the heat exchanger. Moreover, a diameter of at least one of the plurality of bent tubes is different from a diameter of at least one of remaining bent tubes. Furthermore, a cross-sectional area of the inlet header varies along a central longitudinal axis of the inlet header.

BRIEF DESCRIPTION OF THE DRAWINGS

Certain embodiments of the present disclosure will be better understood from the following description taken in conjunction with the accompanying drawings in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows. Embodiments are hereinafter described in detail in connection with the views and examples of FIGS. 1-6, wherein like numbers indicate the same or corresponding elements throughout the views.

Figure 1:
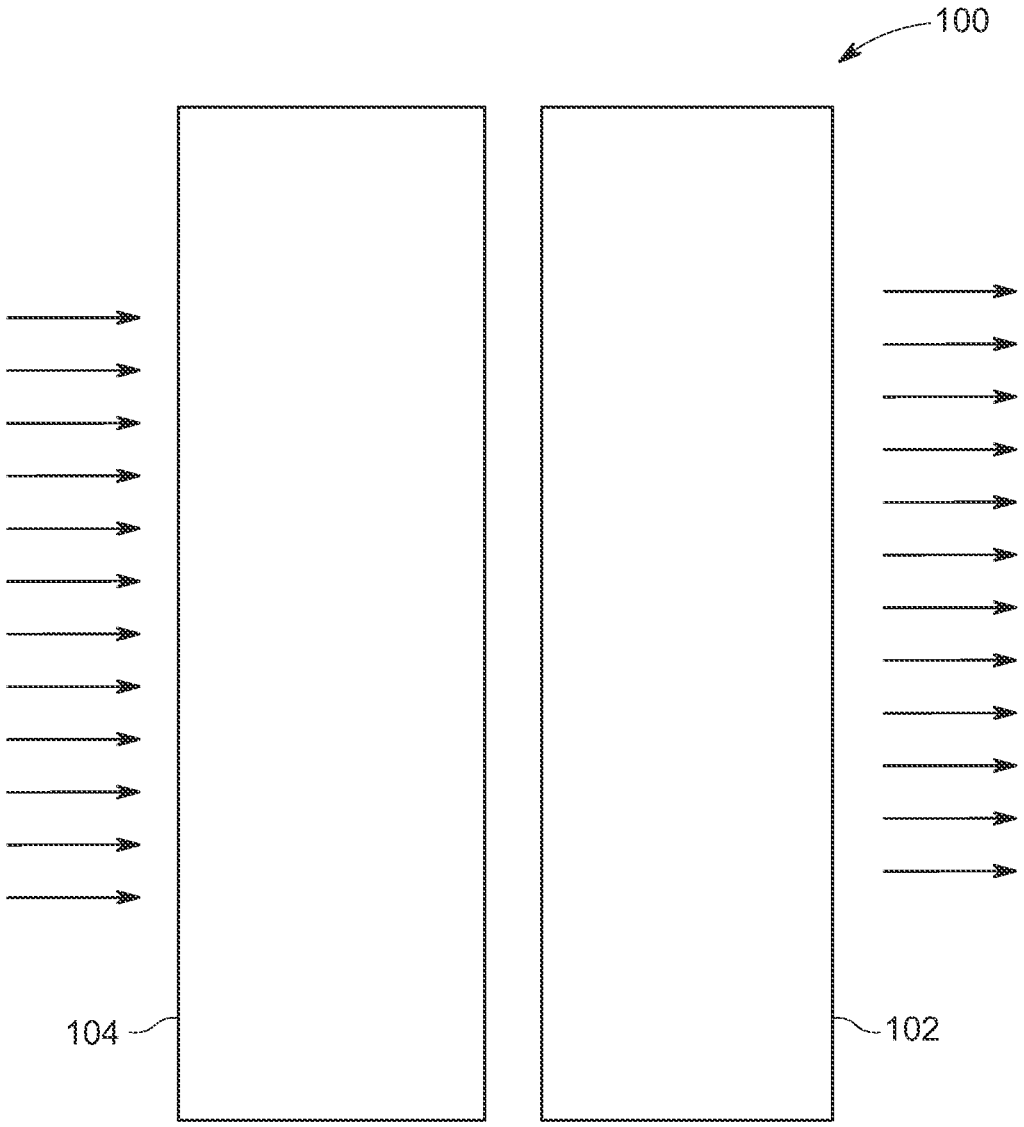
FIG. 1 is schematic view of a heat transfer system having a heat exchanger and a fan, in accordance with one embodiment of the present disclosure.
Figure 2:
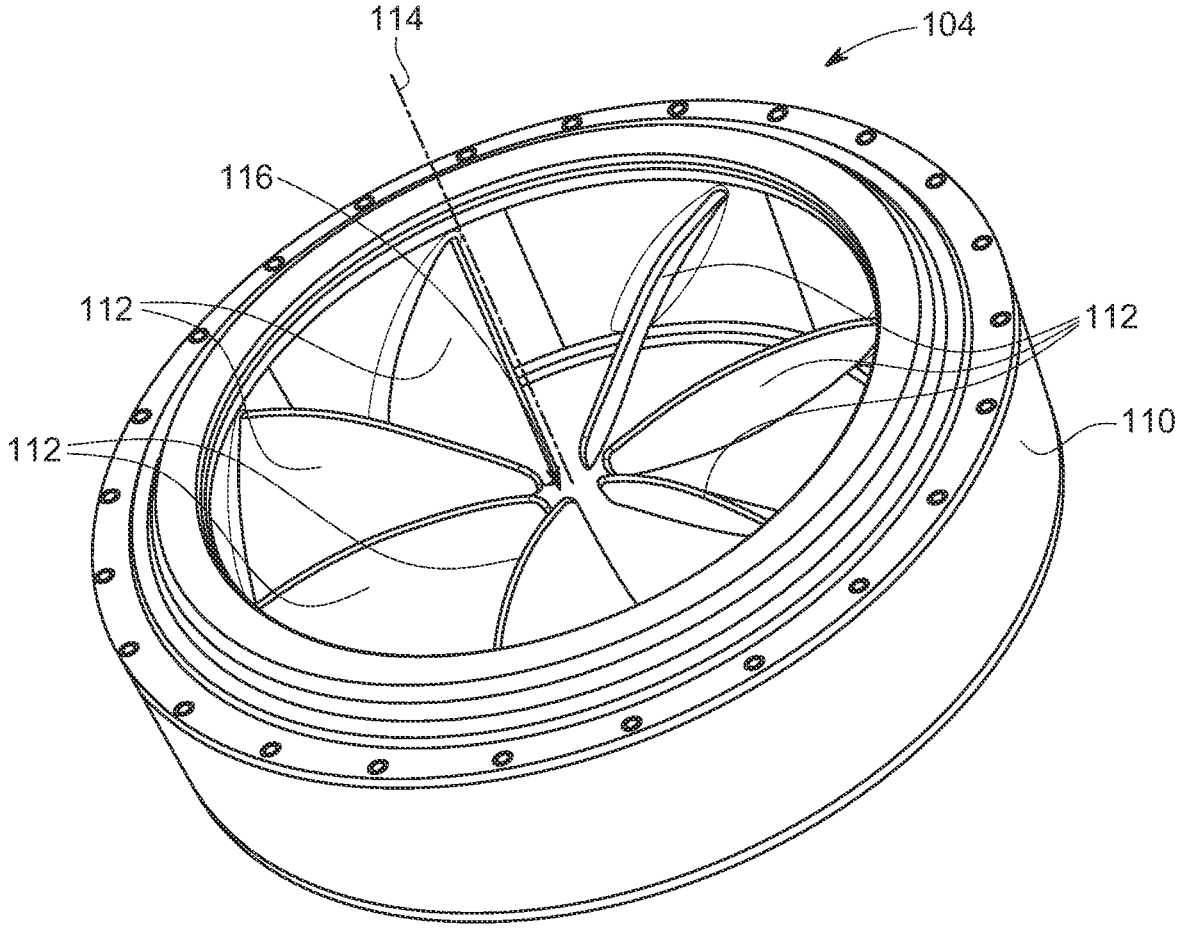
FIG. 2 is perspective view of the fan, in accordance with one embodiment of the present disclosure.

FIG. 1 illustrates a schematic view of heat transfer system 100 having a heat exchanger 102 and a fan 104 arranged downstream or upstream of the heat exchanger 102 in a direction of flow of air and configured to provide a flow of air through the heat exchanger 102. As shown in FIG. 2, in an embodiment, the fan 104 may be hub-less fan having a shroud 110 and a plurality of blades 112 extending radially inwardly from the shroud 110 and arrayed circularly around a central axis 114 of the shroud 110. As shown, outer ends of the blades 112 are attached to an inner surface of the shroud 112, while inner ends are arranged proximate to the central axis 114 defining a gap 116 therebetween. Although the fan 104 is shown and contemplated as the hub-less fan, it may be appreciated that fan 104 may include a hub with blades extending radially outwardly of the hub. The heat transfer system 100 is configured to heat or cool a fluid flowing through the heat exchanger 102 by facilitating a heat transfer between the fluid flowing through the heat exchanger 102 and air generated by the fan 104.

Figure 3:
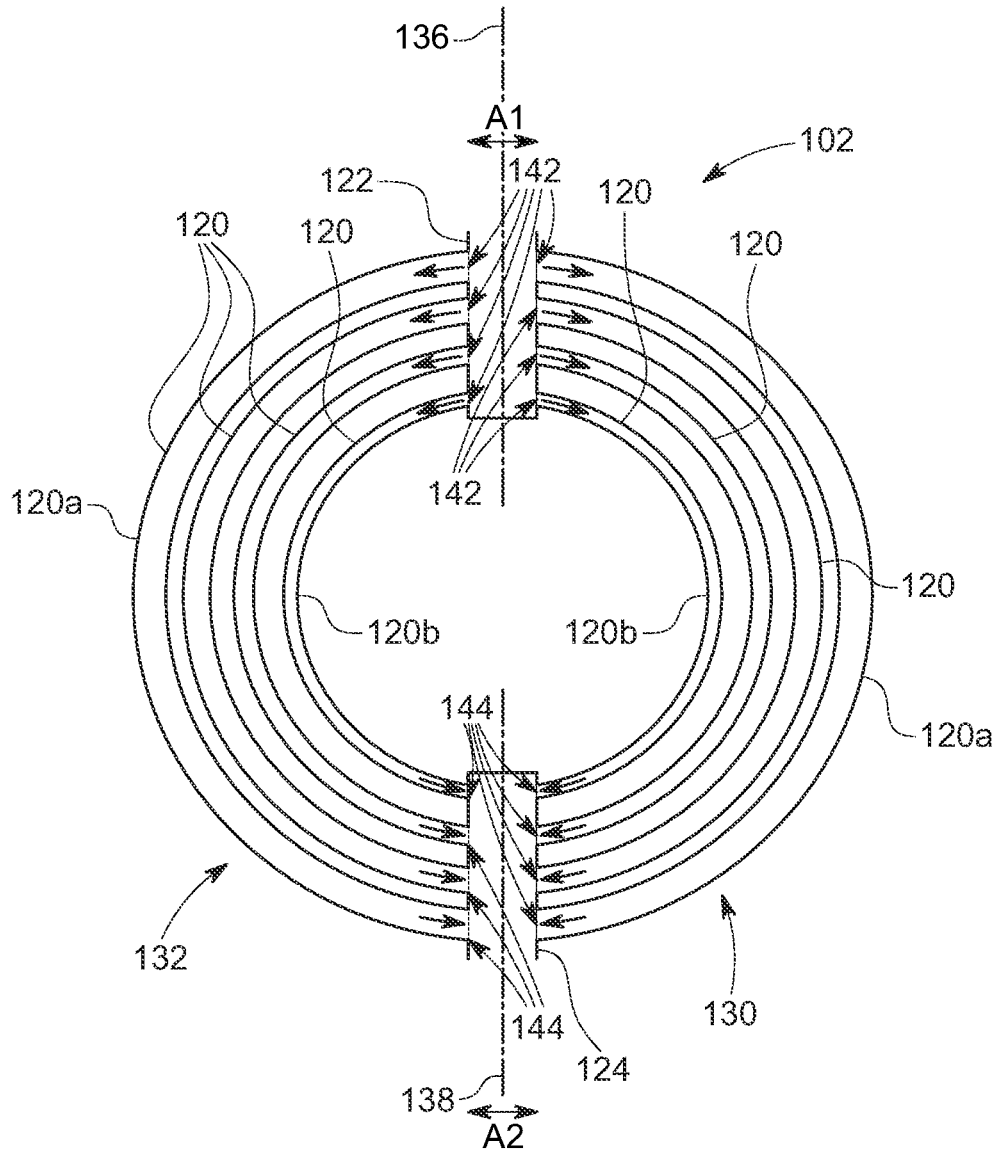
FIG. 3 is a front view of a heat exchanger having a plurality of bent tubes arranged in a coplanar configuration and having varying diameters, in accordance with one embodiment of the present disclosure.
Figure 4:
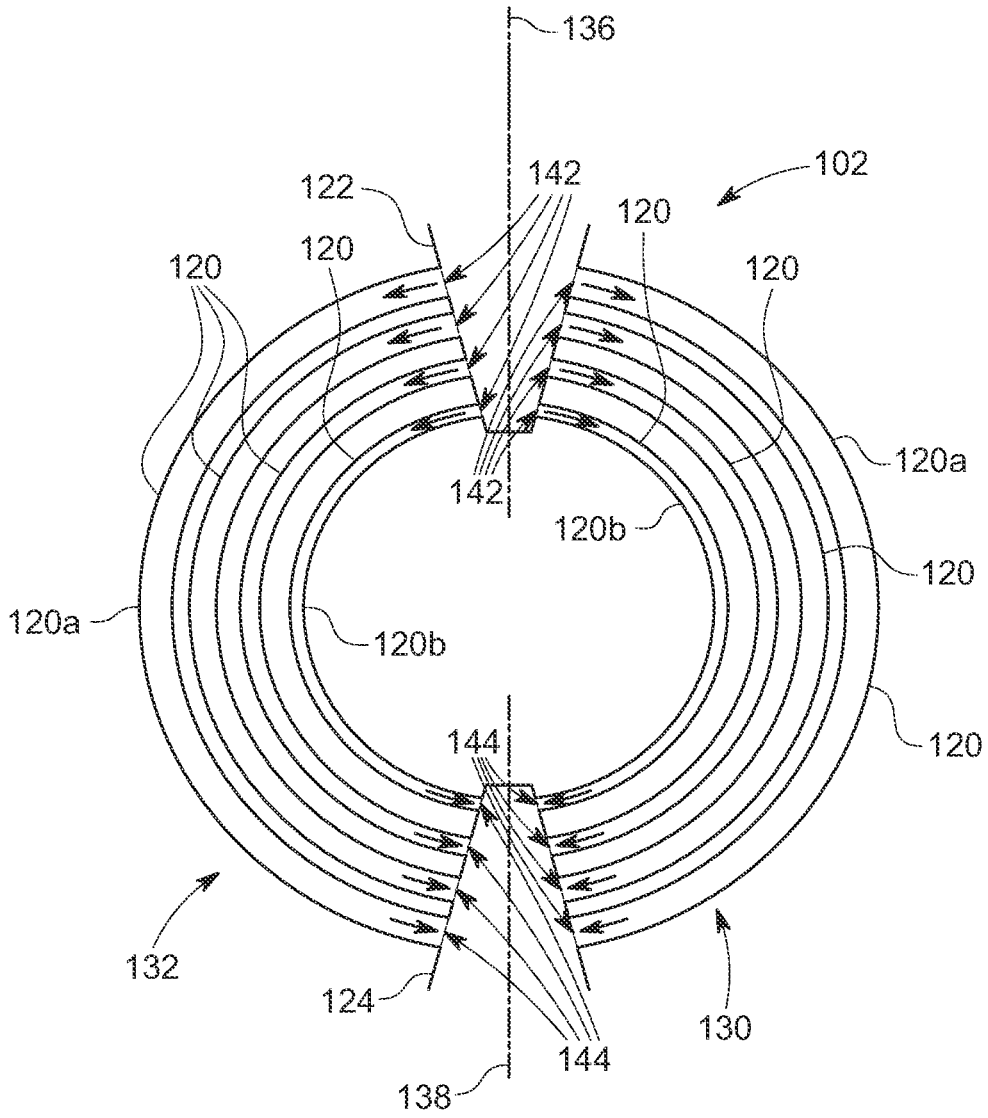
FIG. 4 is a front view of a heat exchanger having a plurality of bent tubes arranged in a coplanar configuration and having varying diameters and an inlet header and an outer header, each having a varying cross-sectional area, in accordance with one embodiment of the present disclosure.
Figure 5:
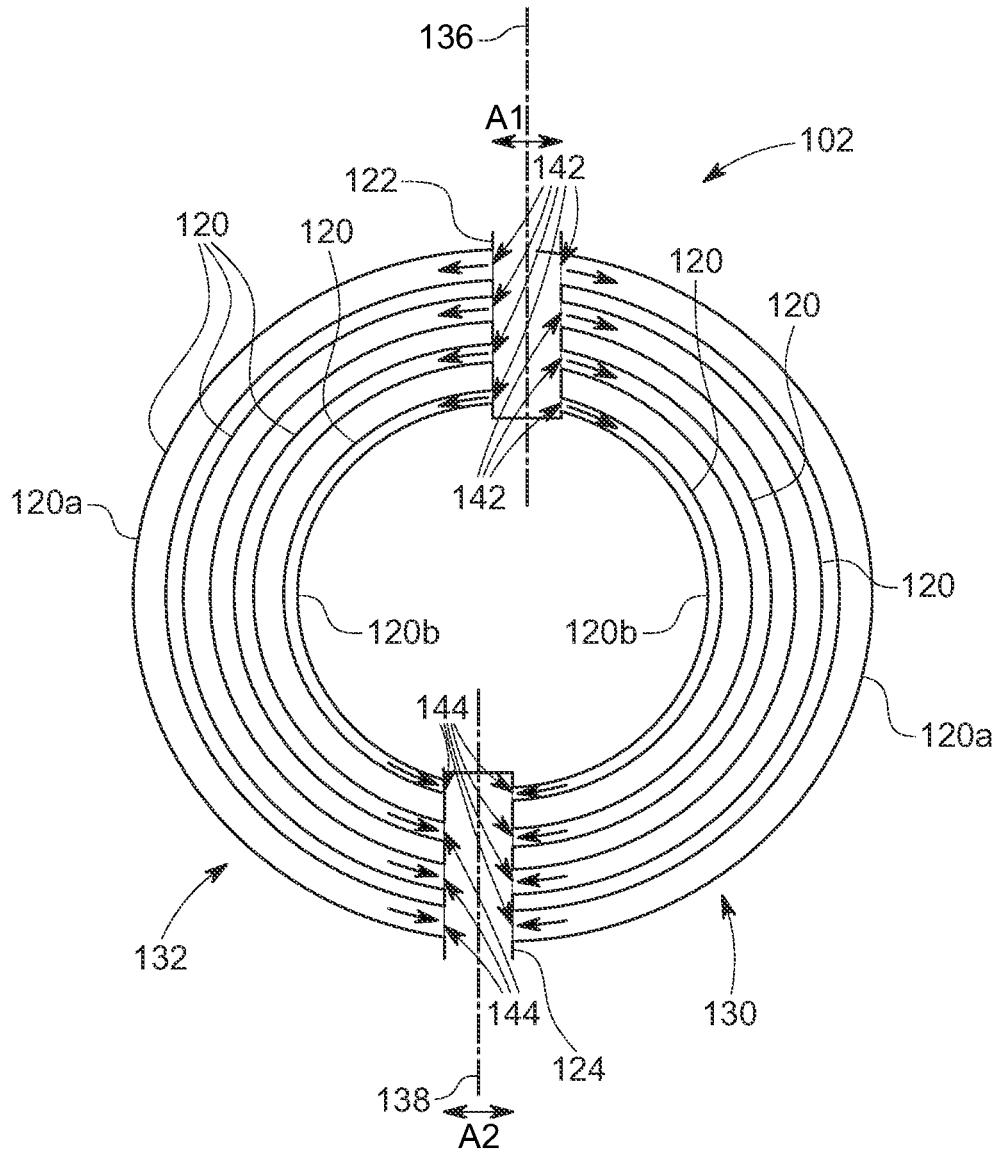
FIG. 5 is a front view of a heat exchanger having a plurality of bent tubes arranged in a coplanar configuration and having varying diameters with an inlet header and an outer header arranged offset from each other, in accordance with one embodiment of the present disclosure.

Referring to FIGS. 3 to 5, the heat exchanger 102 includes a plurality of bent tubes 120 through which the fluid flows, an inlet header 122 coupled to the plurality of bent tubes 120 and facilitates an inlet of fluid inside the bent tubes 120 and an outlet header 124 to receive the fluid from the bent tubes 120. The inlet header 122 receives the fluid, for example, coolant, from an external device, for example, an engine, while the outlet header 124 facilitates and exit of the fluid from the heat exchanger 102.

As shown, the plurality of bent tubes 120 is arranged concentrically to each other and are coplanar with each other. As shown, the plurality of bent tubes extends from the inlet header 122 and to the outlet header 124 and is connected to the inlet header 120 and the outlet header. In the illustrated embodiment, each of the bent tubes 120 is in the form an arc of a circle having a first end connected to the inlet header 122 and a second end connected to the outlet header 124. Further, the plurality of bent tubes 120 includes a first tube group 130 arranged on a first side of the inlet header 122 and the outlet header 124 and a second tube group 132 arranged on a second side of the inlet header 122 and the outlet header 124. As shown in FIGS. 3 and 4, the inlet header 122 and the outlet header 124 are arranged opposite, for example, diametrically opposite, to each other such that a central longitudinal axis 136 of the inlet header 122 and a central longitudinal axis 138 of the outlet header 124 are aligned with each other. Although, the inlet and outlet headers 122, 124 are shown to be arranged diametrically opposite to each other, it may be appreciated that the inlet header 122 and the outlet header 124 are arranged side by side and in such a case, the plurality of bent tubes 120 include only one tube group, for example, the first tube group 130. Also, in some embodiments, as shown in FIG. 5, although the inlet header 122 and the outlet header 124 are arranged opposite to each other, the inlet header 122 and the outlet header 124 are arranged such that the central longitudinal axis 136 of the inlet header 122 and the central longitudinal axis 138 of the outlet header 124 are arranged at an offset from each other.

Also, it may be appreciated that the first tube group 130 and second tube group 132 are identical to each other in construction, structure, and assembly. As illustrated in FIGS. 3 to 5, the diameters and hence the cross-sectional areas of the bent tubes 120 vary from each other. For example, as shown in FIGS. 3 to 5, a first bent tube 120*a* (i.e., outermost bent tube 120*a*) has a largest diameter i.e., cross-sectional area, while a fourth bent tube 120*b* (i.e., inner most bent tube 120*b*) has a smallest diameter i.e., cross-sectional area. Also, as shown in FIG. 3 and FIG. 5, a width i.e., a cross-sectional area 'A1' of the inlet header 122 may be constant along its entire length. Similarly, a cross-sectional area 'A2' of the outlet header may be constant along its entire length. However, in some embodiments, to ensure a uniform distribution of flow of coolant to each of the bent tubes 120, the cross-sectional area 'A1' of the inlet header 122 varies along a length (i.e., central longitudinal axis 136) of the inlet header 122. For example, as shown, the cross-sectional area 'A1' of the inlet header decreases in a direction away from an inlet opening of the inlet header 122, as shown in FIG. 4. Similarly, the cross-sectional area 'A2' of the outlet header 124 varies along a length (i.e., central longitudinal axis 138) of the outlet header 124.

Further, the inlet header 122 defines a plurality of inlet ports 142 at junctions of the bent tubes 120 with the inlet header 122 to enable a flow of the coolant to the bent tubes 120 from the inlet header 122. Similarly, the outlet header 124 defines a plurality of outlet ports 144 at the junctions of the bent tubes 120 with the outlet header 124 to enable an exit of the coolant from the bent tubes 120 to the outlet header 122. In an embodiment, cross-sectional areas of the inlet ports 142 and/or the outlet ports 144 vary along the length of the inlet header 122 and the outlet header 124 and correspond to the cross-sectional areas, sizes, or diameters of the bent tubes 120. Additionally, or optionally, each of the plurality of bent tubes 120 may include plurality of fins (not shown) to improve the heat transfer. In some embodiments, the inner surface of each of the bent tubes 120 may be made rough or smooth or corrugated or rifled etc., to control the flow regime and the heat transfer.

Figure 6:
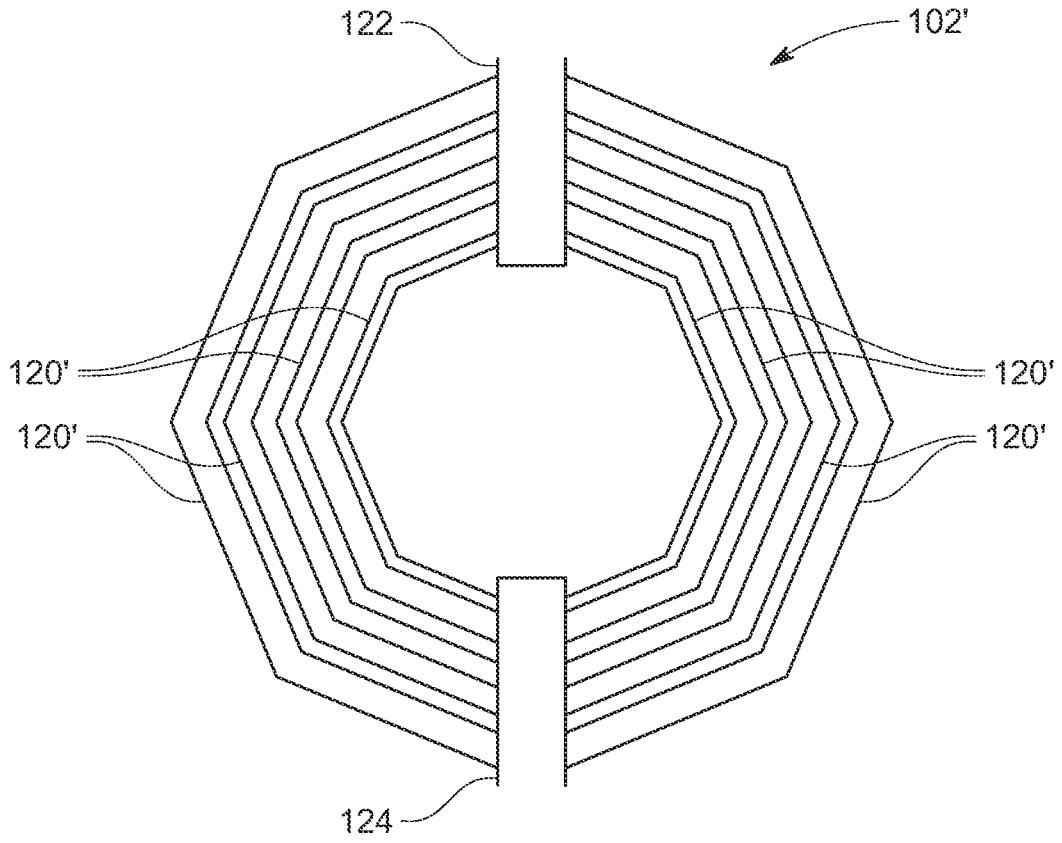
FIG. 6 is a front view of a heat exchanger having a plurality of bent having polygonal shape and arranged in a coplanar configuration, in accordance with one embodiment of the present disclosure.

Referring to FIG. 6, a heat exchanger 102' is shown according to an alternative embodiment, the heat exchanger 102' is similar to the heat exchanger 102 except the bent tubes 120' of the heat exchanger include polygonal shape instead of an arcuate shape.

The heat exchanger 102, 102' improve the overall heat transfer efficiency compared to traditional heat exchangers at the heat exchanger 102, 102' have increased effective fan-swept area relative to the traditional heat exchangers. Also, the bent tubes 120, 120' are arranged such that the restriction to the air flow passing through the bent tubes 120, 120' is minimized, leading to increased heat exchange efficiency.

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate certain principles and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A heat exchanger, comprising:

an inlet header;

an outlet header; and a plurality of concentrically arranged bent tubes extending from the inlet header to the outlet header, the bent tubes being arranged coplanar to each other with the inlet header and the outlet header extending radially outwardly from a location proximate to a central axis of the heat exchanger, wherein a diameter of at least one of the plurality of bent tubes is different from a diameter of at least one of remaining bent tubes, and a cross-sectional area of the inlet header varies along a central longitudinal axis of the inlet header such that the cross-sectional area of the inlet header decreases in a direction away from an inlet opening of the inlet header.

2. The heat exchanger of claim 1, wherein the plurality of bent tubes includes a first tube group arranged on a first side of the inlet header and the outlet header, and a second tube group arranged on a second side of the inlet header and the outlet header.

3. The heat exchanger of claim 1, wherein the inlet header defines a plurality of inlet ports to enable a flow of a fluid to the plurality of bent tubes, and the outlet header defines a plurality of outlet ports to facilitate an exit of the fluid from the plurality of bent tubes.

4. The heat exchanger of claim 1, wherein each of the plurality of bent tubes extends arcuately around the central axis.

5. The heat exchanger of claim 4, wherein the inlet header and the outlet header are disposed diametrically opposite to each other.

6. The heat exchanger of claim 4, wherein the inlet header and the outlet header are arranged opposite to each other with a central longitudinal axis of the inlet header disposed at an offset from a central longitudinal axis of the outlet header.

7. The heat exchanger of claim 1, wherein a cross-sectional area of the outlet header varies along a central longitudinal axis of the outlet header.

8. The heat exchanger of claim 1, wherein each of the plurality of bent tubes defines a substantially polygonal shape.

9. A heat transfer system, comprising:

a fan; and a heat exchanger arranged upstream or downstream of the fan relative to a direction of air flow generated by the fan, the heat exchanger includes an inlet header, an outlet header, and a plurality of concentrically arranged bent tubes extending from the inlet header to the outlet header, the bent tubes being arranged coplanar to each other with the inlet header and the outlet header extending radially outwardly from a location proximate to a central axis of the heat exchanger, wherein a diameter of at least one of the plurality of bent tubes is different from a diameter of at least one of remaining bent tubes, and a cross-sectional area of the inlet header varies along a central longitudinal axis of the inlet header such that the cross-sectional area of the inlet header decreases in a direction away from an inlet opening of the inlet header.

10. The heat transfer system of claim 9, wherein the plurality of bent tubes includes a first tube group arranged on a first side of the inlet header and the outlet header, and a second tube group arranged on a second side of the inlet header and the outlet header.

11. The heat transfer system of claim 9, wherein the inlet header defines a plurality of inlet ports to enable a flow of a fluid to the plurality of bent tubes, and the outlet header defines a plurality of outlet ports to facilitate an exit of the fluid from the plurality of bent tubes.

12. The heat transfer system of claim 9, wherein the inlet header and the outlet header are disposed diametrically opposite to each other.

13. The heat transfer system of claim 9, wherein the inlet header and the outlet header are arranged opposite to each other with a central longitudinal axis of the inlet header disposed at an offset from a central longitudinal axis of the outlet header.

14. The heat transfer system of claim 9, wherein a cross-sectional area of the outlet header varies along a central longitudinal axis of the outlet header.

15. The heat transfer system of claim 9, wherein each of the plurality of bent tubes defines a substantially polygonal shape.

16. The heat transfer system of claim 9, wherein the fan is a hub-less fan including a shroud and a plurality of blades arrayed circularly around a central axis of the shroud and extending radially inwardly from an inner surface of the shroud.

17. A heat exchanger, comprising:

an inlet header;

an outlet header arranged diametrically opposite the inlet header and aligned along a central longitudinal axis to the inlet header; and a plurality of concentrically arranged bent tubes including a first tube group and a second tube group, each extending from the inlet header to the outlet header such that the first tube group and the second tube group are arranged on opposite sides of the central longitudinal axis with the inlet header and the outlet header being arranged therebetween, the bent tubes being arranged coplanar to each other with the inlet header and the outlet header extending radially outwardly from a location proximate to a central axis of the heat exchanger, wherein a diameter of at least one of the plurality of bent tubes is different from a diameter of at least one of remaining bent tubes, and a cross-sectional area of the inlet header varies along the central longitudinal axis of the inlet header such that the cross-sectional area of the inlet header decreases in a direction away from an inlet opening of the inlet header.

* * * * *